US005743222A

United States Patent [19]

Adachi

[11] Patent Number: 5,743,222

[45] Date of Patent: Apr. 28, 1998

[54] VALVE LIFTER

[75] Inventor: Shuhei Adachi, Iwata, Japan

[73] Assignee: Yamaha Hatsudoki Kabushiki Kaisha, Iwata, Japan

[21] Appl. No.: 736,414

[22] Filed: Oct. 24, 1996

[30] Foreign Application Priority Data

Oct. 24, 1995 [JP] Japan ..... 7-275532

[51] Int. Cl.[6] ..... F01L 1/14

[52] U.S. Cl. ..... 123/90.48; 123/90.51; 74/569

[58] Field of Search ..... 123/90.48, 90.51, 123/90.52, 90.55; 74/569

[56] References Cited

U.S. PATENT DOCUMENTS 4,475,490 10/1984 Oono et al. ..... 123/90.48
4,538,562 9/1985 Matsui et al. ..... 123/90.51
4,850,095 7/1989 Akao et al. ..... 123/90.51
5,237,967 8/1993 Willermet et al. ..... 123/90.51

FOREIGN PATENT DOCUMENTS 61-175203 8/1986 Japan ..... 123/90.48
62-118014 5/1987 Japan ..... 123/90.48

*Primary Examiner*—Weilun Lo
*Attorney, Agent, or Firm*—Knobbe, Martens, Olson & Bear LLP

[57] ABSTRACT

An improved, light weight tappet and method of manufacturing such a tappet. The tappet is comprised of a light weight sleeve to which a hardened disk is metallurgically bonded.

12 Claims, 5 Drawing Sheets

VALVE LIFTER

BACKGROUND OF THE INVENTION

This invention relates to a valve lifter for a reciprocating machine and more particularly to an improved, lightweight, wear-resistant lifter and method of making such a lifter.

It has been proposed in a wide variety of types of reciprocating machines, and particularly internal combustion engines, to employ a valve lifter that is interposed between the camshaft and the poppet-type valve for actuating the valve. These lifters are frequently referred to as tappets, and one of the more commonly used types of tappets is the so-called thimble tappet.

The tappet derives this name from the fact that it is comprised of a cylindrical body portion that is slidably supported in a bore formed in the engine, normally the cylinder head. This cylindrical body is closed at one end by an integral wall that is engaged on one side by the cam lobe and which is engaged on the other side with either the valve stem or an interposed shim or adjusting pad for actuating the valve.

Conventionally, these tappet bodies have been formed from a high-strength material such as a high-grade steel. However, one of the advantages of direct or semi-direct valve actuation is the reduction of the reciprocating masses. When a steel tappet is employed, it adds considerably to the reciprocating mass of the engine, and thus reduces engine performance.

There have been proposed, therefore, tappet bodies that are made from a lighter weight material such as aluminum or aluminum alloys. Although the aluminum based material has the definite advantage of weight reduction, the area where the tappet body is engaged by the cam lobe and engages the valve stem or shim is subject to quite high wear. As a result, it has been necessary to attach to the tappet body a higher strength material which engages either the cam lobe, the valve stem or valve actuating shim, or both.

Typically, these composite constructions have been formed by creating an interlocking bond between the tappet body and the harder, more wear-resistant material. Examples of these types of construction are found in U.S. Pat. No. 5,251,587, entitled "Valve Lifter for Engine," issued Oct. 12, 1993, and assigned to the assignee hereof, and U.S. Pat. No. 5,438,754, entitled "Method of Making a Valve Lifter for Engine," issued Aug. 8, 1995, and also assigned to the assignee hereof. In the structures shown in these two patents, the aluminum tappet body has affixed to it by a mechanically interlock a hardened insert disk which serves either or both of the functions of engagement with the cam lobe and also engagement with the valve stem or valve actuating shim.

Although these constructions achieve a light weight, the mechanical bonding technique requires considerable force and applies high stresses to the interlocked portions of the components. This may result in premature failure, particularly when operating under high speeds, high loads, and at high temperatures.

It is, therefore, a principal object of this invention to provide an improved lightweight tappet for actuating the valve in a reciprocating machine such as an engine.

It is a further object of this invention to provide an improved tappet and method of manufacturing the tappet wherein a lightweight construction can be employed, a hardened, wear-resistant surface employed, and the two dissimilar materials are affixed together in such a manner that the likelihood of their becoming disassembled or damaged in operation is substantially reduced.

It is a further object of this invention to provide a metallurgically bonded tappet for an engine and a method for making such a tappet.

SUMMARY OF THE INVENTION

A first feature of this invention is adapted to be embodied in a lightweight tappet for actuating a valve in a reciprocating machine. The tappet comprises a generally open tubular member formed an aluminum or an aluminum alloy that is mounted for reciprocation in a bore formed in the engine body. A hardened, wear-resistance disk formed from a material dissimilar from that of the tappet body is metallurgically bonded to the tappet body and operates to transmit motion between a cam lobe and a valve stem.

Another feature of the invention is adapted to be embodied in a method for forming a tappet body as described in the preceding paragraph. This method comprises the step of forming the tubular lightweight body from an aluminum alloy. This cylindrical body is held in a fixture and a hardened disk is pressed into the body and heat is generated so as to achieve a metallurgical bond between the tappet body and the disk without any substantial alloying of the two materials.

DETAILED DESCRIPTION OF THE PREFERRED EMBODIMENTS OF THE INVENTION

Figure 1:
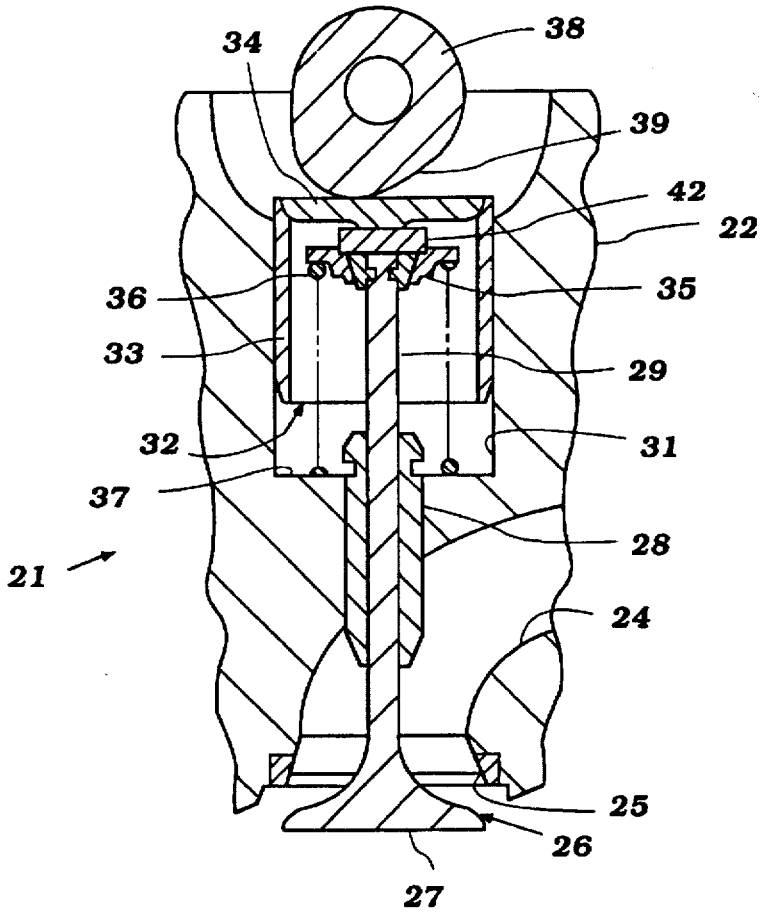
FIG. 1 is a cross-sectional view taken through a portion of a reciprocating machine having a valve actuated by a tappet body manufactured and constructed in accordance with an embodiment of the invention.

Referring now in detail to the drawings and initially to FIG. 1, a portion of a reciprocating machine such as an internal combustion engine is shown in cross-section and is identified by the reference numeral 21. Although the invention has utility in a wide variety of types of applications wherein lightweight high strength and high wear resistance in localized areas are desired, the invention has particular utility in applications as illustrated.

The illustrated embodiment is comprised of an internal combustion engine having a cylinder head 23 which is formed with a flow passage 24 that terminates at a valve seat 25. The valve seat 25 is opened and closed by the head of a poppet-type valve, indicated generally by the reference numeral 26, with the head portion being identified by the reference numeral 27. The valve 26 is slidably supported in the cylinder head 22 by a valve guide 28 that has a cylindrical opening through which a stem 29 of the poppet valve 26 extends.

An upper portion of the cylinder head 22 at the upper termination of the valve guide 28 is provided with a cylindrical opening 31 in which a tappet body, indicated generally by the reference numeral 32 is slidably supported for actuating the valve 28. The construction of the tappet body 32 will be described later but it is comprised primarily of a cylindrical sleeve portion 33 which is formed from a lightweight material such as aluminum or aluminum alloys, as will be described later, and a disk-shape member 34 which is metallurgically bonded to the upper end of the cylindrical body 33 and closes it in a manner which also will be described.

A keeper retainer assembly 35 cooperates with the valve stem 29 and is engaged by one end of a coil compression spring 36. The other end of the spring 36 engages a machine surface 37 at the base of the bore 31 so as to normally urge the valve 26 to its closed position.

A camshaft 38 is rotatably journaled in the cylinder head 22 and is driven in a known manner. The camshaft 38 has a cam lobe 39 which engages the disk shaped portion 34 of the tappet 32 so as to compress the spring 36 and open the valve 26 as shown in FIG. 1. Except for the construction and manner in which the tappet 32, the aforedescribed structure is of the type known in the art.

Figure 2:
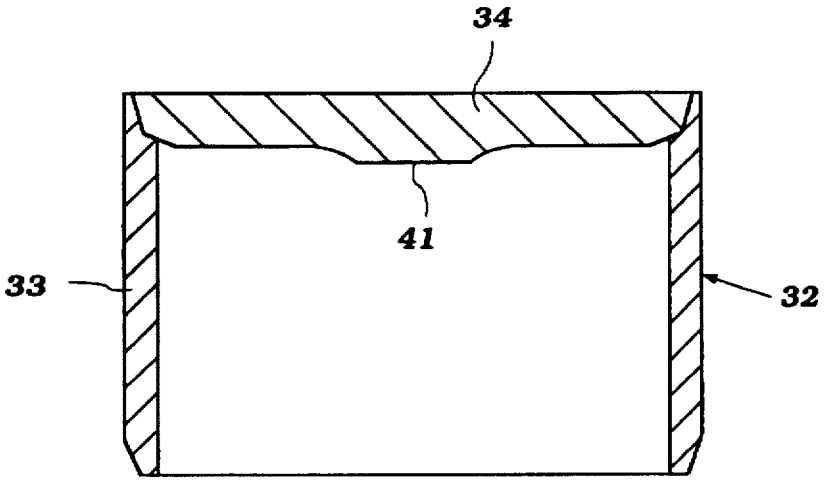
FIG. 2 is an enlarged cross-sectional view of the tappet body.

As may be seen in the enlarged view of FIG. 2, the tappet body 32 and specifically the underside of the disk-shape member 34 is formed with a downwardly extending projection 41. This projection 41 normally engages an adjusting shim 42 that is held in place by the retainer 35 and is utilized to adjust clearances between the tappet body and the cam lobe 39 in the manner known in the art.

The tubular member 33 of the tappet 32 is formed from a suitable lightweight material such as aluminum alloy of the types known under Japanese Industrial Standard (JIS) as 5056, 6063, AC4C. Also, it may be an alloy of the type sold under the trade name KOBELCO and its designation KTM-10.

The body 33 is primarily formed from aluminum or an aluminum alloy as has been noted and it may be treated to provide certain surface hardness or certain surface coatings which may also be impregnated therein such as molybdenum, molybdenum, nickel and chrome and also coating materials, if desired.

The body of the disk 34 is formed primarily from sintered iron and may have in its intercises copper, silicon, zinc, silver, tin or other materials. In addition, before the disk 34 is bonded to the sleeve 33 it may be formed with a coating, indicated by the reference numeral 43 in FIGS. 3–6, of copper or the aforenoted materials. This coating and embedded material not only adds to the conductivity of electricity, but also will provide for the formation of an eutectic alloy during the bonding process that has a lower melting temperature than the base metals so as to facilitate the metallurgical bonding without alloying between the base material of the disk 34 and the sleeve 33. This will be described in more detail by a particular reference to FIGS. 3–6 when the actual bonding process is described.

Figure 3:
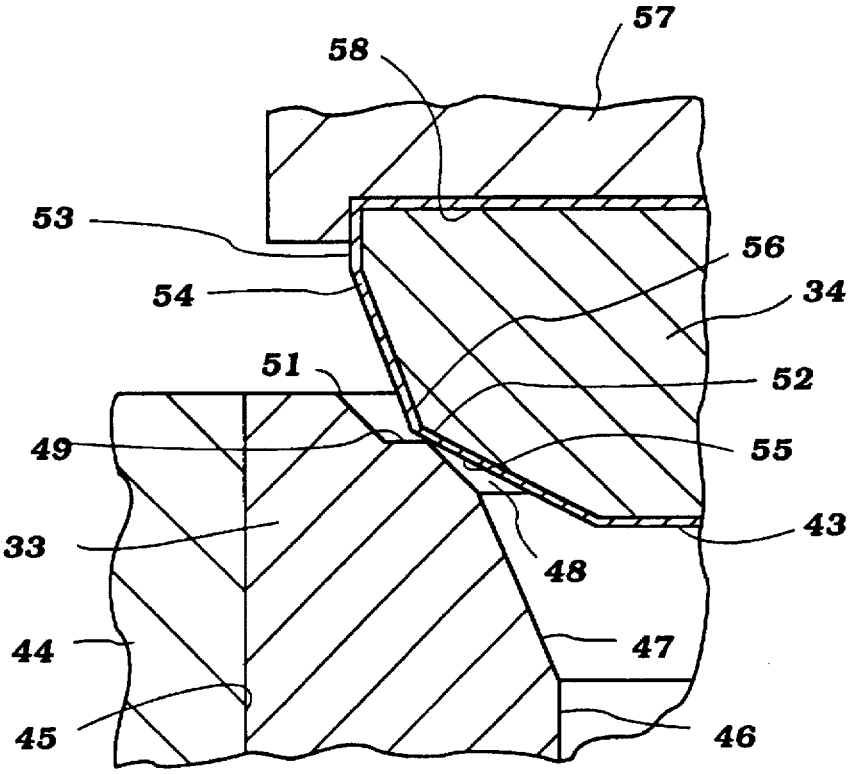
FIGS. 3–7 are sequential enlarged cross-sectional views showing the sequential steps of how the tappet body of FIG. 2 is finally formed.
Figure 4:
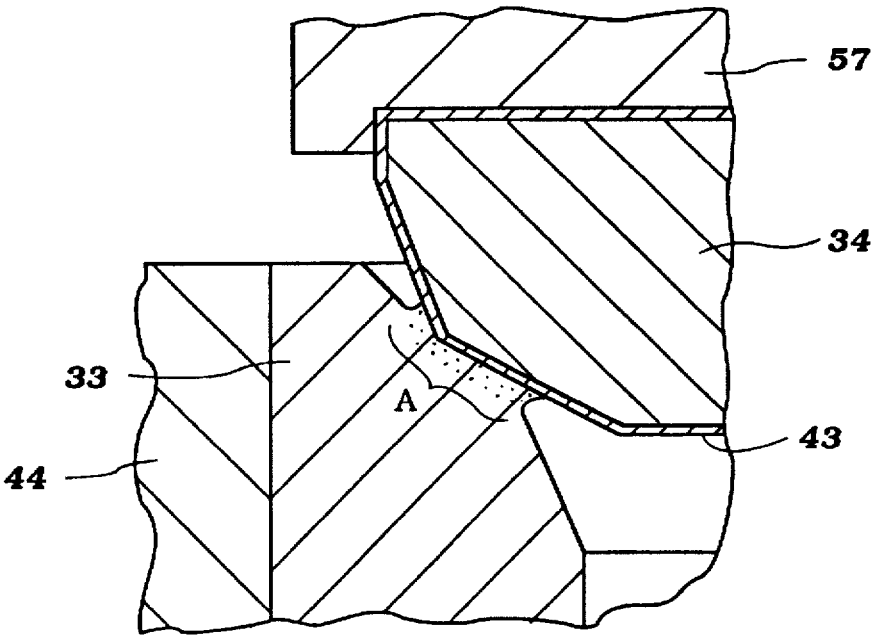

Referring now in detail to FIGS. 3–7, an initially to FIGS. 3, the cylindrical body 33 is placed in a fixture 44 which has a cylindrical opening 45 generally complimentary to the outer surface of the sleeve 33. In addition, at the base of the bore 45, there is provided a flat surface so as to hold the sleeve 33 against axial movement. The mounting base or fixture 44 is connected to a suitable source of electricity for a reason which will become apparent shortly.

The cylindrical member 33 has an inner bore 46 which is specially machined to form a recess at its upper end as best seen in FIG. 3. This machined recess is comprised of a first tapered, conical portion 47 that extends upwardly and outwardly to a more steeply tapered conical section 48. The conical section 48 terminates in a surface 49 that extends circumferential shoulder that extends in a generally radial direction. This surface 49 is bounded at its outer edge by a further tapered conical surface 51 with the taper of the portion 51 being equal to or slightly greater than the taper of the surface 48. This configuration results in the formation of an edge 52.

The disk 34 has a cylindrical outer surface 53 of a diameter that is approximately equal to the outer peripheral edge of the tapered section 51 of the sleeve 33. Depending therefrom is a conical section 54 that has a lesser taper in the pressing direction which is the direction of the axis of the cylindrical surface 46 of the sleeve 33 than the tapers of the surfaces 51 and 48 of the sleeve 33. This surface 54 terminates in a more steeply tapered surface 55 which has a greater taper than that of the surfaces 48 and 51 and results in the formation of a sharp edge 56. This sharp edge 56 is slightly offset from the sharp edge 52 of the sleeve 33. Finally, the disk-shape member 33 terminates in its lower surface which has the projection 41 as aforenoted.

A pressing mandrel, indicated generally by the reference numeral 57, is brought axially into engagement with the disk-shape member 34. A recess 58 is formed in the end thereof which is complimentary to the disk-shape portion 34 so as to assist in its location relative to the fixture 44.

FIG. 3 shows the construction and arrangement when the disk-shape member 34 is first inserted into the sleeve 34 and the pressing mandrel 57 moves downwardly to create initial contact. At this time, the mandrel 57, which is also connected to an electrical power source, is in contact so that there is a path for electrical energy to pass from the mandrel 57 to the fixture 44 through the disk-shape member 34, coating 43 and sleeve 33.

As the pressing begins, a force is exerted in the direction of the axis of the sleeve cylindrical portion 46 an electrical current is passed through the aforenoted path. This causes a melt zone, indicated by the range A in FIGS. 4–7 to form. In this melt zone, the coating material forms a eutectic alloy with the aluminum of the sleeve 33 which eutectic alloy has a lower melting point than either that of the coating or of the sleeve 33. As the pressure increase, this coating continues to alloy and the resulting eutectic alloy is expelled as indicated by the areas B in FIGS. 5 and 6.

This results in a situation wherein there is a very fine metallurgical bond between the base material of the disk 34 and the base material of the sleeve 33 with no significant alloying therebetween. In other words, a metallurgical bond is formed. There will be no change in the metallurgical properties of the either the disk member 34 or the sleeve 33. The melt area A will, however, experience some work hardening because of the compressive force which is exerted. This actually adds to the strength of the resulting assembly.

Figure 5:
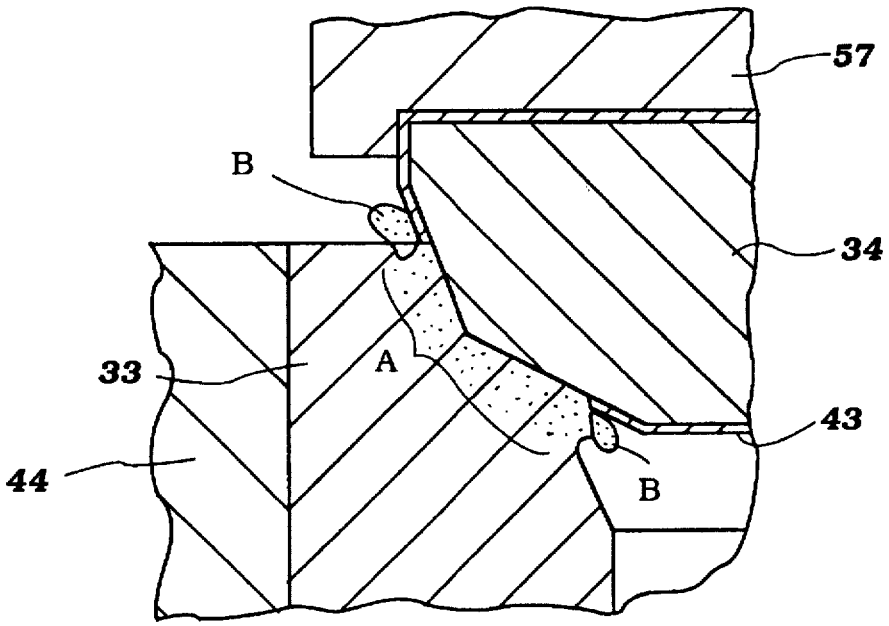
Figure 6:
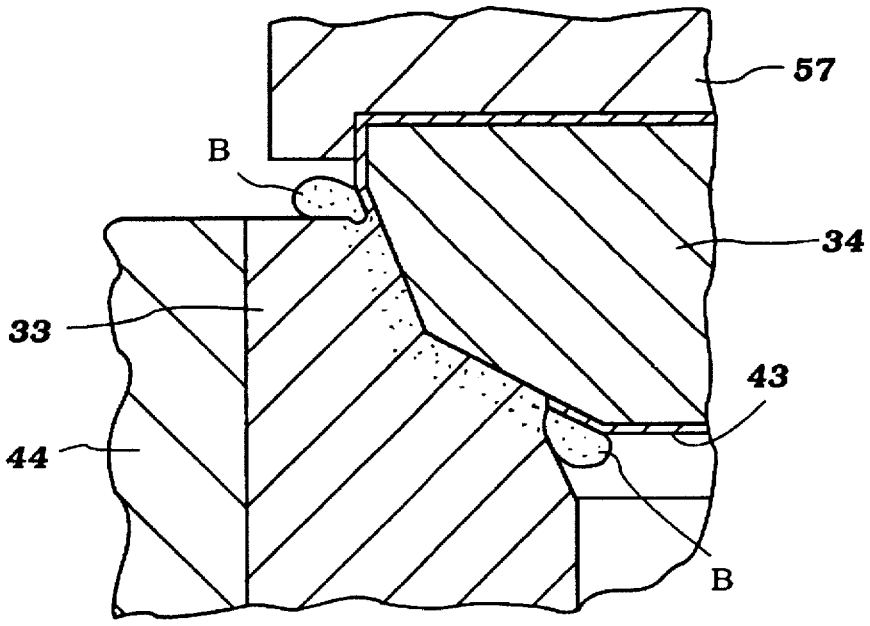
Figure 7:
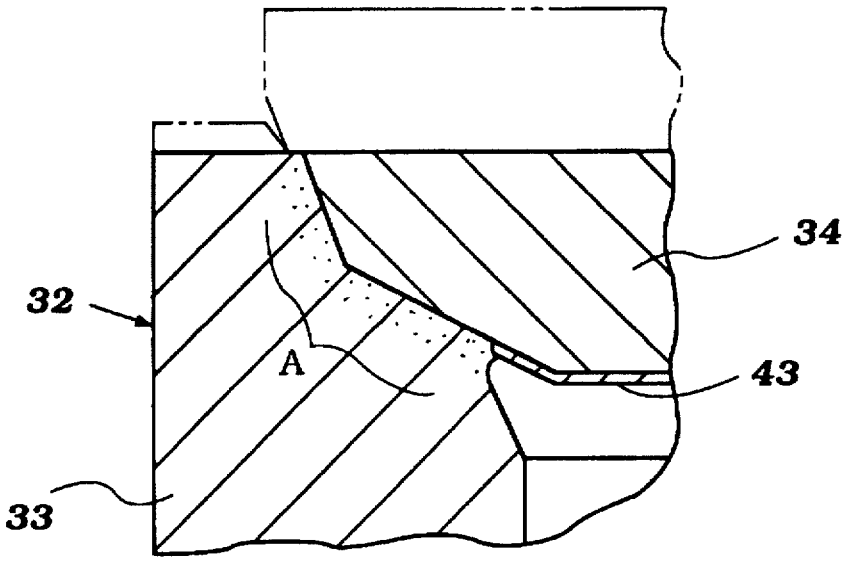

The pressing continues through the steps shown in FIGS. 5 and 6 until the final bond is formed as shown in FIG. 7. The upper portion of the disk 34 and the upper surface of the sleeve 33 may be machined slightly to provide a smooth finished surface. In addition, the melt reaction areas B at the upper surface will be machined away resulting in a high purity.

Because of the fact that the mount of initial contact is small, the melting will be confined to the area of contact and this will continue during the continued pressing process. The electric current can be controlled and the sink rate of the disk 34 into the sleeve 33 measured so as to assure that there is no actual alloying of the materials but only a metallurgical bonding.

The coating layer 43 also assist in removing any surface oxides which may be present on the sleeve 33 during the initiation of the process. Hence, the resulting bond is metallurgically quite pure and there will be no surface imperfections entrained in the joined surfaces. In addition to having a high strength, the resulting tappet can have a weight that is only 35% of the weight of a conventional tappet formed entirely from a high-strength steel. The resulting structure will also have higher wear resistance because of the ability to use a more expensive material for the disk-like material 34 than would be practical for the entire tappet body and which would not be necessary for the entire tappet body.

Figure 8:
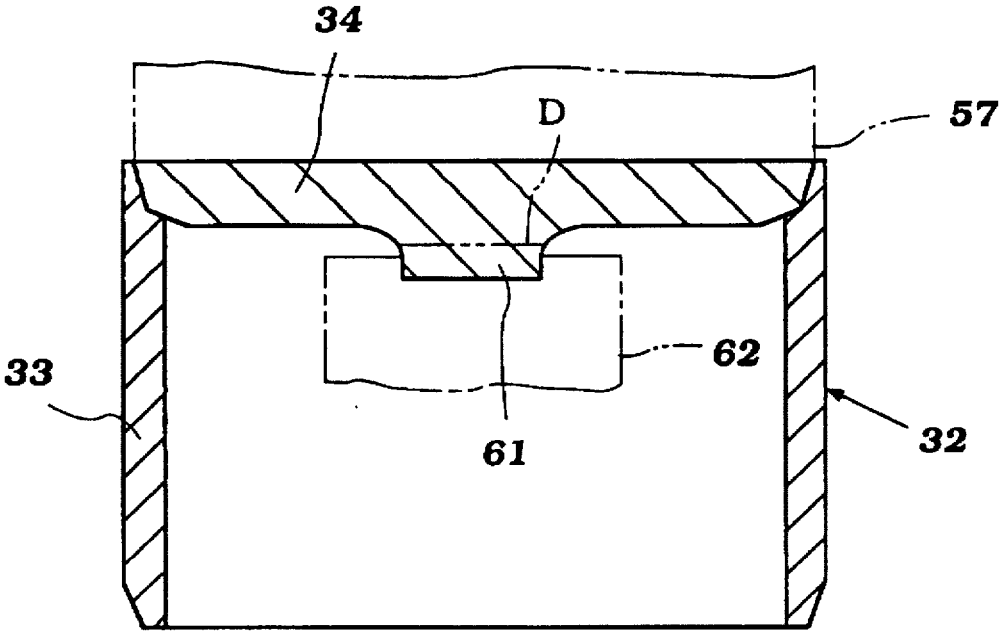
FIG. 8 is a cross-sectional view, in part similar to FIG. 7, and shows another embodiment of the invention.

FIG. 8 shows a modification which may be employed in order to assist in insuring against bending of the disk 34 during installation and also as to monitor the sink rate. In this embodiment, the lower disk surface is provided with an extended portion 61 that is received in a backup mandrel 62. The backup mandrel 62 will move downwardly as the disk 34 is embedded in the sleeve 33 and its movement can be measured so as to assure that the proper sink rate is being experienced in a given time to insure the desired bond.

A portion of the projection 61 is subsequently machined away down to the line D shown in FIG. 8 so as to provide a good machined surface and one which will be totally planer.

The particular configuration of the recess at the upper end of the sleeve 33 and the shape of the disk 34 to assist in the bonding technique has already been noted. Although one particular configuration has been described, other configurations are possible. Examples of these other configurations are shown in FIGS. 9–12 and now will be described by reference thereto.

Figure 9:
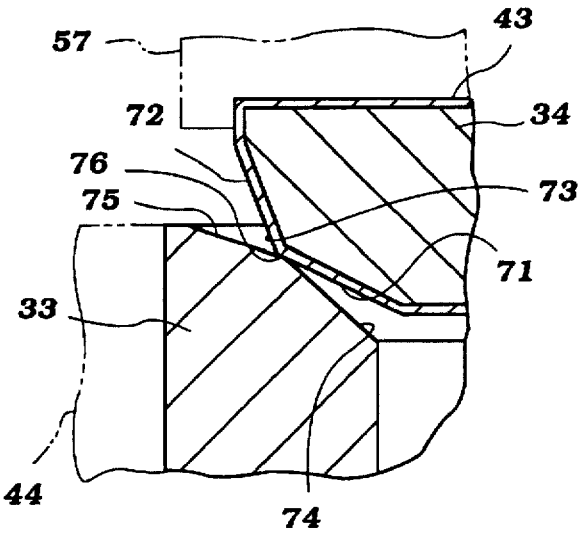
FIGS. 9–12 are cross-sectional views, in part similar to FIG. 3, and show other configurations for utilization in forming the tappet.

Referring first to FIG. 9, the sleeve 33 and disk 34 have been identified by the same reference numerals and the only portion of them that will be described is their mating surfaces prior to the metallurgical bonding. In the embodiment of FIG. 9, the disk 34 is provided with a pair of conical surfaces 71 and 72 that meet at an edge 73. This configuration is basically similar to the configuration previously described.

In this embodiment, however, the sleeve recess is comprised of a first conical section 74 and a joining second conical section 75 that result in an edge 76. In this embodiment there is no flat surface but merely two edges which assist in the adjoining technique as a aforedescribed.

Figure 10:
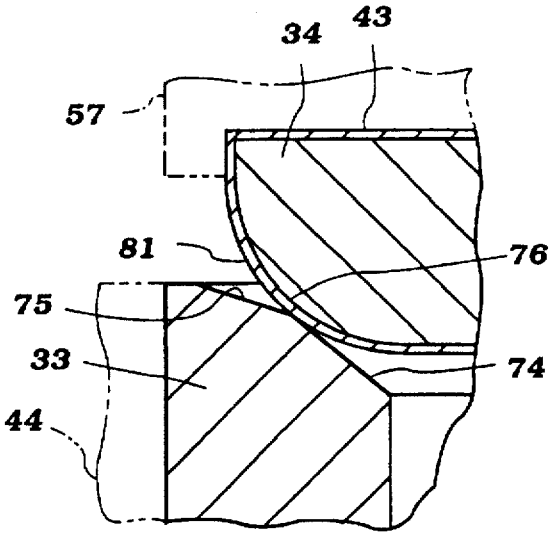

FIG. 10 shows another embodiment that uses a recess for the sleeve 33 as shown in FIG. 9. In this embodiment, however, the disk is formed with a radius portion 81 which will still provide a point contact at the area of the edge 76 to assist in the desired melting rate.

Figure 11:
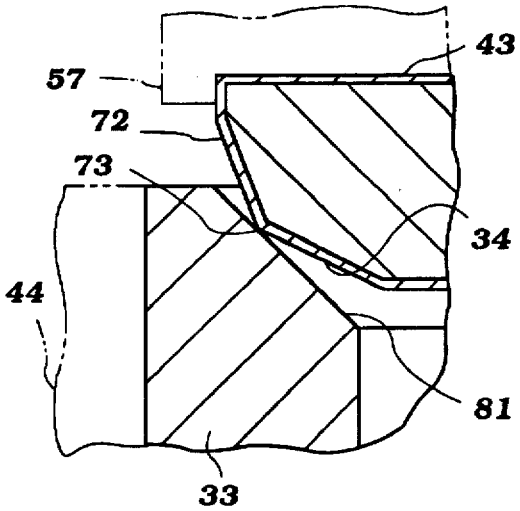

FIG. 11 shows another configuration wherein the disk 34 is configured like the one shown in FIG. 9. However, the sleeve 33 is formed with a simple taper 81 which still results in an initial point contact at the disk edge 73.

Figure 12:
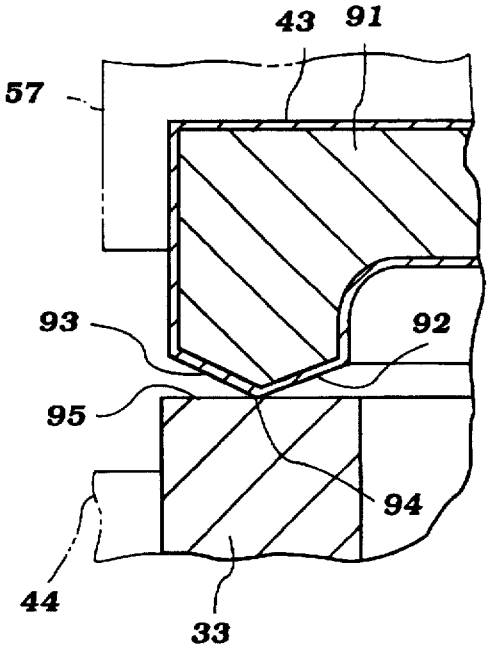

In all of the embodiments thus far described, the disk 34 has been received in a recess formed at the upper end of the sleeve 33. This type of arrangement has the advantage of assisting in coaxial locating of the two components. This is not necessary, however, in FIG. 12 shows an embodiment wherein the disk is formed with a circular projection 91 defined by a pair of angular-related portions 92 and 93 that result in the formation of a sharp edge 94. This sharp edge 94 can contact a planer upper surface 95 of the sleeve 33 so as to provide bonding on the axial end face of the sleeve 33.

Thus, from the foregoing description it should be readily apparent that the various embodiments of the invention are particularly adapted to provide a very good method and resulting valve actuating tappet. Of course, various changes and modifications may be made without departing from the spirit of and scope of the invention, as defined by the appended claims.

What is claimed is:

1. A valve actuating tappet for operating a poppet valve of a reciprocating machine from a cam, said reciprocating machine having a bore in which said tappet is slidably supported, said tappet being comprised of a tubular body having an axis and formed from a first, light weight metal, a recess formed in said tubular body at one end thereof, and a disk shaped member having an end portion received at least in part in said recess and metallurgically bonded to and closing one end of said tubular member, said disk being formed from a second metal harder and more wear resistant than said first metal, said recess and said end portion having cooperating tapered portions disposed at different angles to the axis of said tubular body and lying in the metallurgically bonded area.

2. A valve actuating tappet as set forth in claim 1, wherein the disk shaped member is bonded to the tubular body by solid-state diffusion, without forming an alloy therebetween.

3. A valve actuating tappet as set forth in claim 2, wherein a plastic deformation layer is formed on the bonding boundary at least in the tubular body.

4. A valve actuating tappet as set forth in claim 3, wherein the disk shaped member is sintered.

5. A valve actuating tappet as set forth in claim 4, wherein the disk shaped member has metal deposits capable of forming an eutectic alloy with the tubular body.

6. A valve actuating tappet as set forth in claim 1, wherein the first metal is selected from the group of aluminum and an aluminum alloy and the second metal is selected from the group of sintered ferrous, copper and nickel.

7. A valve actuating tappet as set forth in claim 6, further including a coating on at least the surface of the disk shaped member formed from a third metal selected from the group of copper, tin, zinc, silver, aluminum, or silicon or an alloy thereof, said third metal forming an eutectic alloy with said first metal, said eutectic alloy having a lower melting point than that of either said first or said third metals.

8. A valve actuating tappet as set forth in claim 7, wherein the disk shaped member is sintered.

9. A valve actuating tappet as set forth in claim 8, wherein the disk shaped member has metal deposits capable of forming an eutectic alloy with the tubular body.

10. A valve actuating tappet as set forth in claim 1, wherein the angle of the tubular body tapered portion is greater than the angle of the disk shaped member tapered portion.

11. A valve actuating tappet as set forth in claim 1, wherein one end the tubular member recess is stepped.

12. A valve actuating tappet as set forth in claim 11, wherein the step in the tubular member recess is formed to constitute the first point of contact with the disk shaped member when it is placed in the recess.

* * * * *